US008684349B2

(12) United States Patent
Asada et al.

(10) Patent No.: US 8,684,349 B2
(45) Date of Patent: Apr. 1, 2014

(54) SHEET FEEDER AND IMAGE RECORDING APPARATUS

(75) Inventors: Tetsuo Asada, Kuwana (JP); Keisuke Wakakusa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 185 days.

(21) Appl. No.: 12/729,008

(22) Filed: Mar. 22, 2010

(65) Prior Publication Data

US 2011/0074093 A1 Mar. 31, 2011

(30) Foreign Application Priority Data

Sep. 30, 2009 (JP) ..... 2009-227037

(51) Int. Cl.
*B65H 3/34* (2006.01)

(52) U.S. Cl.
USPC ..... 271/167; 271/121

(58) Field of Classification Search
USPC ..... 271/145, 121, 161, 167
See application file for complete search history.

(56) References Cited

U.S. PATENT DOCUMENTS

| | | | | |
|---|---|---|---|---|
| 5,899,450 | A * | 5/1999 | Gettelfinger et al. | 271/121 |
| 6,139,007 | A * | 10/2000 | Cahill et al. | 271/121 |
| 6,279,897 | B1 | 8/2001 | Richards | |
| 6,874,779 | B2 * | 4/2005 | Park | 271/121 |
| 6,942,209 | B2 * | 9/2005 | Kawakami | 271/121 |
| 7,036,814 | B2 * | 5/2006 | Oh et al. | 271/121 |
| 7,066,461 | B2 * | 6/2006 | Asada | 271/121 |
| 7,108,257 | B2 * | 9/2006 | Shiohara et al. | 271/104 |
| 7,370,859 | B2 * | 5/2008 | Asada | 271/121 |
| 7,946,573 | B2 * | 5/2011 | Asada et al. | 271/121 |
| 7,988,143 | B2 * | 8/2011 | Asada et al. | 271/121 |
| 2002/0070495 | A1 | 6/2002 | Takeuchi | |
| 2004/0026845 | A1 * | 2/2004 | Park | 271/167 |
| 2004/0032076 | A1 * | 2/2004 | Kawakami | 271/121 |

(Continued)

FOREIGN PATENT DOCUMENTS

| | | |
|---|---|---|
| CN | 1456442 A | 11/2003 |
| CN | 1475362 A | 2/2004 |

(Continued)

OTHER PUBLICATIONS

The State Intellectual Property Office of the People'S Republic of China, Notification of First Office Action for Chinese Patent Application No. 201010148862.0, issued Aug. 3, 2011.

(Continued)

*Primary Examiner* — Prasad Gokhale
(74) *Attorney, Agent, or Firm* — Baker Botts L.L.P.

(57) ABSTRACT

A sheet feeder, including; a sheet holding portion; a sheet supply portion; an inclined member having an inclined surface and configured to guide each sheet in a sheet feed direction; and separation protrusions which are provided on the inclined member and each of which protrudes from the inclined surface such that a distal end thereof is located more downstream in the sheet feed direction than a proximal end thereof, wherein each separation protrusion has a contact surface and said each sheet comes into contact with one or more contact surfaces of the separation protrusions, and wherein each separation protrusion protrudes from the inclined surface such that the distal end of one of the separation protrusions is located more downstream in the sheet feed direction than the proximal end of another of the separation protrusions that is located immediately downstream of the one of the separation protrusions in the sheet feed direction.

15 Claims, 13 Drawing Sheets

(56) References Cited

U.S. PATENT DOCUMENTS

| | | | | |
|---|---|---|---|---|
| 2004/0032077 | A1* | 2/2004 | Oh et al. | 271/121 |
| 2004/0084831 | A1 | 5/2004 | Asada | |
| 2005/0194734 | A1 | 9/2005 | Asada et al. | |
| 2006/0180992 | A1* | 8/2006 | Asada | 271/121 |
| 2006/0180993 | A1* | 8/2006 | Lee | 271/121 |
| 2007/0001376 | A1* | 1/2007 | Lim et al. | 271/121 |
| 2008/0230979 | A1 | 9/2008 | Asada et al. | |
| 2009/0243184 | A1* | 10/2009 | Asada et al. | 271/3.14 |
| 2010/0244372 | A1 | 9/2010 | Wakakusa et al. | |
| 2011/0074092 | A1 | 3/2011 | Asada et al. | |
| 2011/0074094 | A1 | 3/2011 | Asada et al. | |

FOREIGN PATENT DOCUMENTS

| | | | |
|---|---|---|---|
| CN | 1796255 | A | 7/2006 |
| JP | H07-251955 | A | 10/1995 |
| JP | 2002-137838 | A | 5/2002 |
| JP | 2002-173239 | A | 6/2002 |
| JP | 2003-048637 | A | 2/2003 |
| JP | 2004-149297 | A | 5/2004 |
| JP | 2005-247550 | A | 9/2005 |
| JP | 3692129 | B2 | 9/2005 |
| JP | 2006-103817 | A | 4/2006 |
| JP | 2006-182481 | A | 7/2006 |
| JP | 2008-230845 | A | 10/2008 |

OTHER PUBLICATIONS

The State Intellectual Property Office of the People'S Republic of China, Notification of First Office Action for Chinese Patent Application No. 201010189523.7 (counterpart Chinese patent application), issued Dec. 5, 2012.

European Patent Office, extended European Search Report for European Patent Application No. 10003043.6 (counterpart European patent application), dated Nov. 22, 2012.

Japan Patent Office, Notification of Reason for Refusal for Japanese Patent Application No. 2009-227037 (counterpart Japanese patent application), mailed Mar. 5, 2013.

* cited by examiner

SHEET FEEDER AND IMAGE RECORDING APPARATUS

CROSS REFERENCE TO RELATED APPLICATION

The present application claims priority from Japanese Patent Application No. 2009-227037, which was filed on Sep. 30, 2009, the disclosure of which is herein incorporated by reference in its entirety.

BACKGROUND OF THE INVENTION

1. Field of the Invention

The present invention relates to a sheet feeder in which sheets supplied from a sheet holding portion are separated by separation protrusions while being guided along an inclined member, and an image recording apparatus equipped with such a sheet feeder.

2. Discussion of Related Art

An image recording apparatus such as an ink-jet printer is equipped with a sheet feeder configured to feed recording sheets accommodated in a sheet tray to a sheet transfer path by a rotational force of a roller. The roller is rotated while being held in contact with an uppermost one of the recording sheets on the sheet tray, whereby the rotational force of the roller is transmitted to the uppermost sheet and the uppermost sheet is fed into the sheet transfer path from the sheet tray. As such a sheet feeder, there is known one that is provided with an inclined sheet-separation plate having a separation member by which leading edges of the recording sheets are separated for preventing multiple feeding of the recording sheets (i.e., multiple sheet feeding), namely, for preventing a plurality of sheets from being fed at one time.

SUMMARY OF THE INVENTION

The conventional separation member is formed by punching of a metal sheet. The separation member is fixed to the inclined sheet-separation plate formed of a synthetic resin, so as to protrude from the surface of the inclined sheet-separation plate on which the recording sheet passes. The leading edges of the recording sheets are separated one by one by the separation member that protrudes from the inclined sheet-separation plate.

The sheet feeder employed in the image recording apparatus or the like is required to feed the recording sheets at a high speed for realizing a high-speed image recording. This results in an increase in the feeding speed of the recording sheets that are fed while the leading edges thereof are separated by the separation member.

Where a plurality of separation protrusions are formed in the separation member that is obtained by punching of the metal plate, for instance, the distance between any adjacent two separation protrusions is larger than the amount of protrusion of each separation protrusion. Accordingly, the leading edge of each recording sheets may come into contact with the inclined sheet-separation plate between adjacent two separation protrusions. The surface of the inclined sheet-separation plate other than the separation protrusions is provided by a member having a small sliding resistance for smooth feeding of the recording sheets, and the inclination angle of the inclined sheet-separation plate is set at a value suitable for sheet feeding. Therefore, the leading edges of the respective recording sheets are not separated between adjacent two separation protrusions, so that the separation member may fail to exhibit satisfactory sheet separation ability.

It is therefore an object of the invention to provide a sheet feeder capable of exhibiting improved sheet separation ability by decreasing a distance between any adjacent two separation protrusions provided on an inclined member, and an image recording apparatus equipped with such a sheet feeder.

The above-indicated object may be attained according to a principle of the invention, which provides a sheet feeder, comprising:

a holding portion having a holding surface on which a plurality of sheets are held in a stack;

a supply portion configured to supply the plurality of sheets sequentially from an uppermost one of the plurality of sheets held on the holding portion;

an inclined member disposed downstream of the holding portion in a direction in which the sheets are supplied by the supply portion and having an inclined surface that faces a leading edge of each of the sheets held on the holding portion while inclining relative to the holding surface, the inclined member being configured to guide said each of the sheets supplied from the holding portion in a sheet feed direction in which said each of the sheets is fed along the inclined surface; and a plurality of separation protrusions which are provided on the inclined member and arranged in the sheet feed direction and each of which protrudes from the inclined surface such that a distal end thereof is located more downstream in the sheet feed direction than a proximal end thereof, wherein each of the separation protrusions has a contact surface and said each of the sheets supplied from the holding portion comes into contact with one or more contact surfaces of the separation protrusions, and wherein each of the separation protrusions protrudes from the inclined surface such that the distal end of one of the separation protrusions is located more downstream in the sheet feed direction than the proximal end of another of the separation protrusions that is located immediately downstream of the one of the separation protrusions in the sheet feed direction.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

1. First Embodiment

There will be hereinafter described one preferred embodiment of the invention with reference to the drawings. It is to be understood that the embodiment described below may be otherwise modified without departing from the scope of the invention defined in attached claims.

[Internal Structure of Printer 11]

Figure 1:
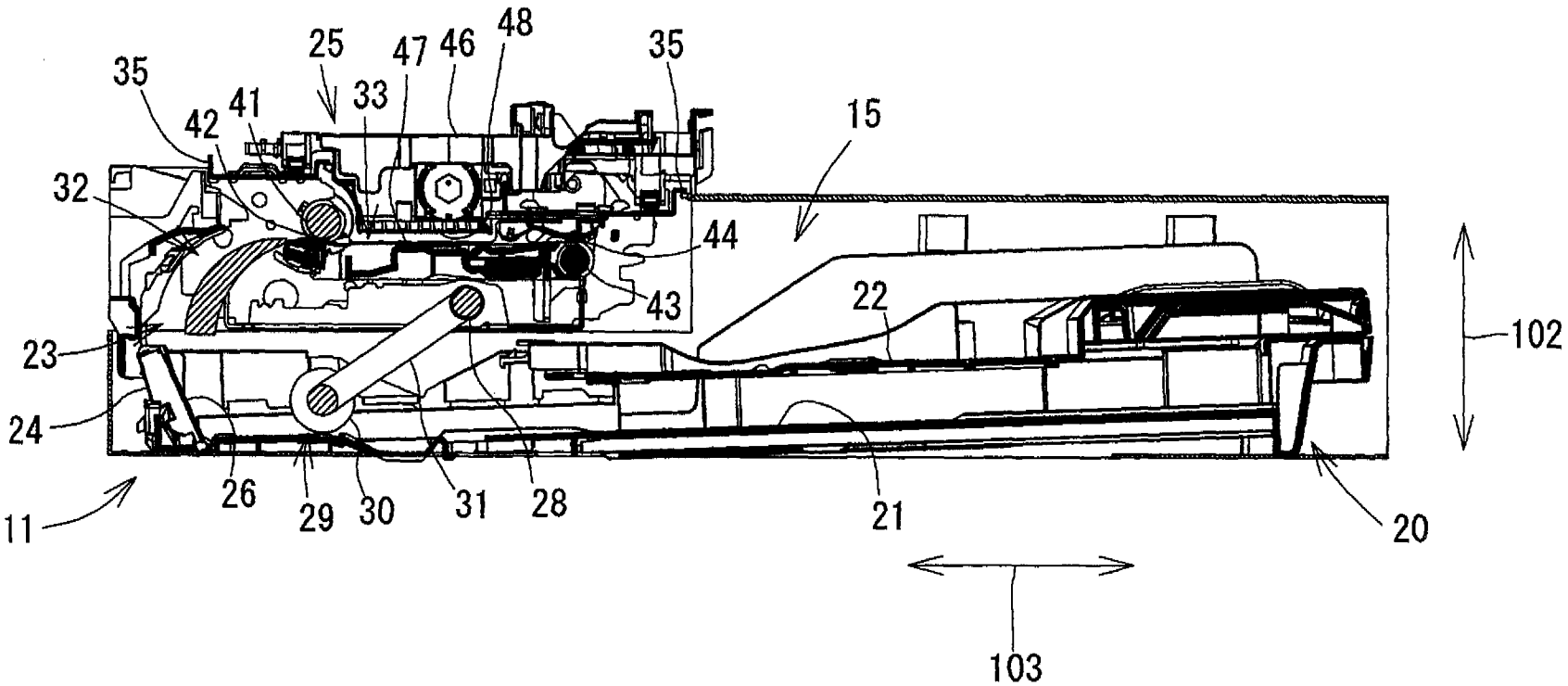
FIG. 1 is a schematic view showing an internal structure of a printer according to one embodiment of the invention.

As shown in FIG. 1, a printer 11 has a sheet transfer path 23 through which each of recording sheets supplied from a sheet cassette 20 is transferred and a recording portion 25 provided in the sheet transfer path 23. In the present embodiment, while the printer 11 will be explained as having only a printing function, the printer 11 may be realized as a multi function device having various functions such as a scanning function, a facsimile function, and a copying function, in addition to the printing function. The printer 11 is an image recording apparatus equipped with a sheet feeder according to the present invention.

In the present embodiment, the directions indicated by arrows 101, 102, 103 in the drawings are a width direction, a height direction, and a depth direction, of the printer 11, respectively. The direction 101 may also be referred to as "a sheet width direction" which is a width direction of each of the recording sheets that is fed. Further, the direction 103 may also be referred to as "a supply direction" in which each of the recording sheets in the sheet cassette 20 is sent.

[Sheet Cassette 20]

As shown in FIG. 1, the sheet cassette 20 is provided so as to be inserted into an inner space 15 of the printer 11 from the front side thereof (the right-hand side in FIG. 1) and withdrawn from the inner space 15 toward the front side. The sheet cassette 20 is a rectangular box whose upper surface is partly open. A plurality of recording sheets are placed or held in a stack on a bottom plate 21 of the sheet cassette 20. The recording sheets placed on the sheet cassette 20 are fed into the sheet transfer path 23 by a sheet supply roller 30. A sheet receiving tray 22 is constituted as a part of the upper surface of the sheet cassette 20. Each of the recording sheets outputted from the sheet transfer path 23 is placed on the sheet receiving tray 22. The sheet cassette 20 is a holding portion, and the upper surface of the bottom plate 21 is a holding surface. Each recording sheet is one example of a sheet.

On the rear side of the sheet cassette 20, there is disposed an inclined member 24 that stands relative to the bottom plate 21. The inclined member 24 is disposed so as to face the leading edge of each of the sheets placed on the bottom plate 21 and, has a flat plate-like shape extending in the width direction 101. The inclined member 24 is inclined such that its upper end portion is located more downstream than its lower end portion in a sheet feed direction 104 in which each of the sheets is fed. Owing to the inclination of the inclined member 24, an inclined surface 26 with which the leading edge of each of the recording sheets comes into contact is formed so as to face the leading edge of the sheet. The inclined member 24 will be explained in detail.

[Sheet Transfer Path 23]

As shown in FIG. 1, the sheet transfer path 23 has a curved portion 32 by which each recording sheet is guided so as to be transferred in a curved form and a straight portion 83 by which the sheet is guided so as to be transferred straight. The curved portion 82 extends upward from the rear side of the sheet cassette 20 and is curved toward the front side of the printer 11. The straight portion **3*e* extends straight from the curved portion 32 toward the front side of the printer 11 near to the sheet receiving tray 22. The recording sheets are supplied from the sheet cassette 20 sequentially to the curved portion 32 and the straight portion 33. The sheet transfer path 23 is a so-called U-turned path constituted by the curved portion 32 and the straight portion 33**.

[Supply Portion 29]

As shown in FIG. 1, the supply portion 29 includes a sheet supply roller 30 and an arm 31. The sheet supply roller 30 is pivotably supported at a distal end portion of the arm 31. The arm 31 is pivotable about a pivot axis 28 whose axial direction coincides with the width direction 101. The sheet supply roller 30 is configured to be inserted, by the pivotal movement of the arm 31, into the sheet cassette 20 at a middle position of the sheet cassette 20 in the width direction 101, so as to come into contact with an uppermost one of the recording sheets stacked on the bottom plate 21. The sheet supply roller 30 is rotated by a drive force transmitted from a motor not shown. When the sheet supply roller 30 is rotated while being held in pressing contact with the uppermost one of the sheets stacked on the sheet cassette 20, the uppermost sheet is fed into the sheet transfer path 23 by a frictional force generated between the uppermost sheet and the sheet supply roller 30.

The above-indicated supply portion 29 and sheet cassette 20 constitute a sheet feeder according to the invention.

[Sheet Transfer Mechanism]

A sheet transfer roller 41 and a pinch roller 42 are provided in the straight portion 33 of the sheet transfer path 23. These rollers 41, 42 are disposed on a more upstream side than the recording portion 25 in a direction in which the sheet is transferred. The sheet transfer roller 41 and the pinch roller 42 form a pair. The pinch roller 42 is movable so as to come into contact with and retract from the sheet transfer roller 41, and is biased by a spring for pressing contact with the sheet transfer roller 41. The sheet transfer roller 41 is configured to be rotated by a drive force transmitted from a motor not shown. The recording sheet held by and between the sheet transfer roller 41 and the pinch roller 42 is transferred to the recording portion 25 by the rotation of the sheet transfer roller 41.

A sheet discharge roller 43 and a spur 44 are provided in the straight portion 33 of the sheet transfer path 23. The sheet discharge roller 43 and the spur 44 are disposed on a more downstream side than the recording portion 25 in the direction in which the sheet is transferred. The sheet discharge roller 43 and the spur 44 form a pair. The spur 44 is movable so as to come into contact with and retract from the sheet discharge roller 43, and is biased by a spring for pressing contact with the sheet discharge roller 43. The sheet discharge roller 43 is configured to be rotated by a drive force transmitted from a motor not shown. The rotation of the sheet discharge roller 43 is synchronism with the rotation of the sheet transfer roller 41. The recording sheet held by and between the sheet discharge roller 43 and the spur 44 is transferred to the sheet receiving tray 22 by the rotation of the sheet discharge roller 43.

[Recording Portion 25]

As shown in FIG. 1, the recording portion 25 is disposed on the straight portion 33 of the sheet transfer path 23 and includes a carriage 46 and a platen 47. The carriage 46 is disposed on the upper side of the platen 47 with the straight portion 33 interposed therebetween. A recording head 48 is mounted on the carriage 46. While not shown in FIG. 1, the recording head 48 has nozzles from which ink droplets are ejected. The recording head 48 is mounted on the carriage 46 such that openings of the nozzles are exposed toward the platen 47.

The carriage 46 is configured to reciprocate, together with the recording head 48, in the width direction 101, i.e., in a direction perpendicular to the sheet plane of FIG. 1, by a drive force transmitted thereto from a motor not shown. The carriage 46 is prevented from moving in the depth direction 103 by engagement thereof with a guide rail 35 that extends in the width direction 101.

During the reciprocating movement of the carriage 46 in the width direction 101, minute ink droplets are selectively ejected from the recording head 48 toward the recording sheet on the platen 47. The ejected ink droplets are attached to the recording sheet, whereby an image is recorded on the recording sheet. The ink is supplied from an ink cartridge not shown to the recording head 48. The recording portion 25 is one kind of a recording device.

[Inclined Member 24]

Figure 2:
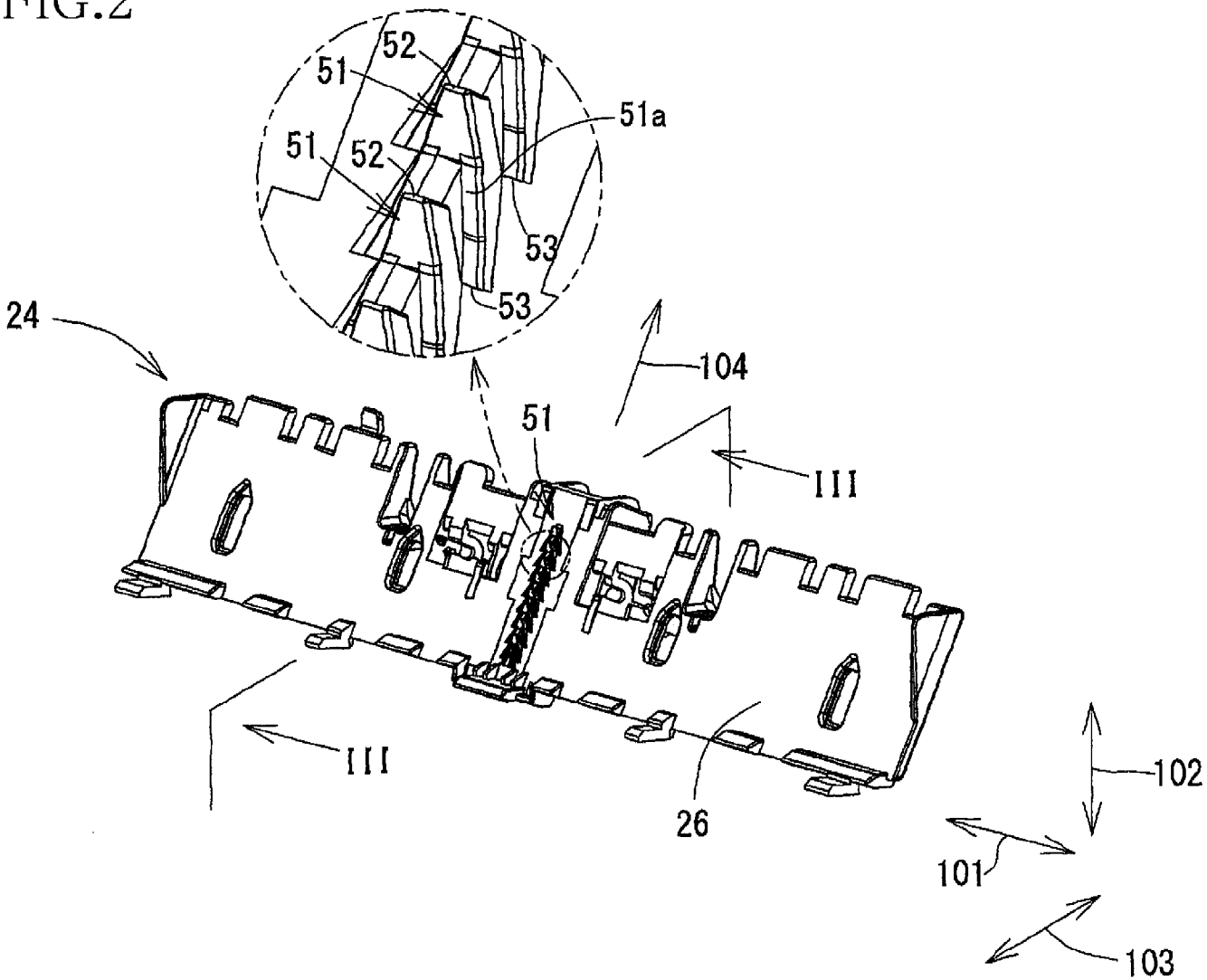
FIG. 2 is a perspective view showing an external appearance of an inclined member.

As shown in FIG. 2, the inclined member 24 has a flat plate shape that is long in the width direction 101. The dimension of the inclined member 24 as measured in the width direction 101 is made larger than the width of a maximum size of the recording sheet that can be placed on the sheet cassette 20. One of opposite surfaces of the inclined member 24 that faces the recording sheets on the sheet cassette 20 is an inclined surface 26. The inclined surface 26 may be a flat plane or a curved plane that is slightly curved along the width direction 101. The inclined surface 26 is configured to contact the leading edge of the recording sheet supplied by the supply portion 29 and to guide the recording sheet slantingly in the upward direction. For smooth guiding of the recording sheet, the inclined surface 26 is formed of a material having a low degree of sliding resistance.

The angle defined by the inclined surface 26 and the upper surface of the bottom plate 21 is determined to be a suitable value that permits the recording sheet to be flexed without stopping for changing the traveling direction of the sheet to the slantingly upward direction, when the recording sheet placed on the bottom plate 21 of the sheet cassette 20 is fed and its leading edge comes into contact with the inclined surface 26. Where the angle defined by the inclined surface 26 and the upper surface of the bottom plate 21 becomes large or becomes close to 90°, namely, where the inclined surface 26 is formed so as to become close to a vertical plane, the recording sheet tends to stop when its leading edge comes into contact with the inclined surface 26, thereby causing a risk of so-called sheet misfeeding or sheet feeding failure in which the recording sheet is not actually fed even though the sheet supply roller 30 operates to feed the sheet. On the other hand, when the angle defined by the inclined surface 26 and the bottom plate 21 becomes small or becomes close to 0°, the height of the inclined surface 26 decreases, resulting in a decrease of the number of the recording sheets that can be placed on the sheet cassette 20. Accordingly, the angle of the inclined surface 26 relative to the bottom plate 21 is suitably set such that the recording sheet can be smoothly guided while taking account of the number of the sheets placed on the sheet cassette 20.

Figure 3:
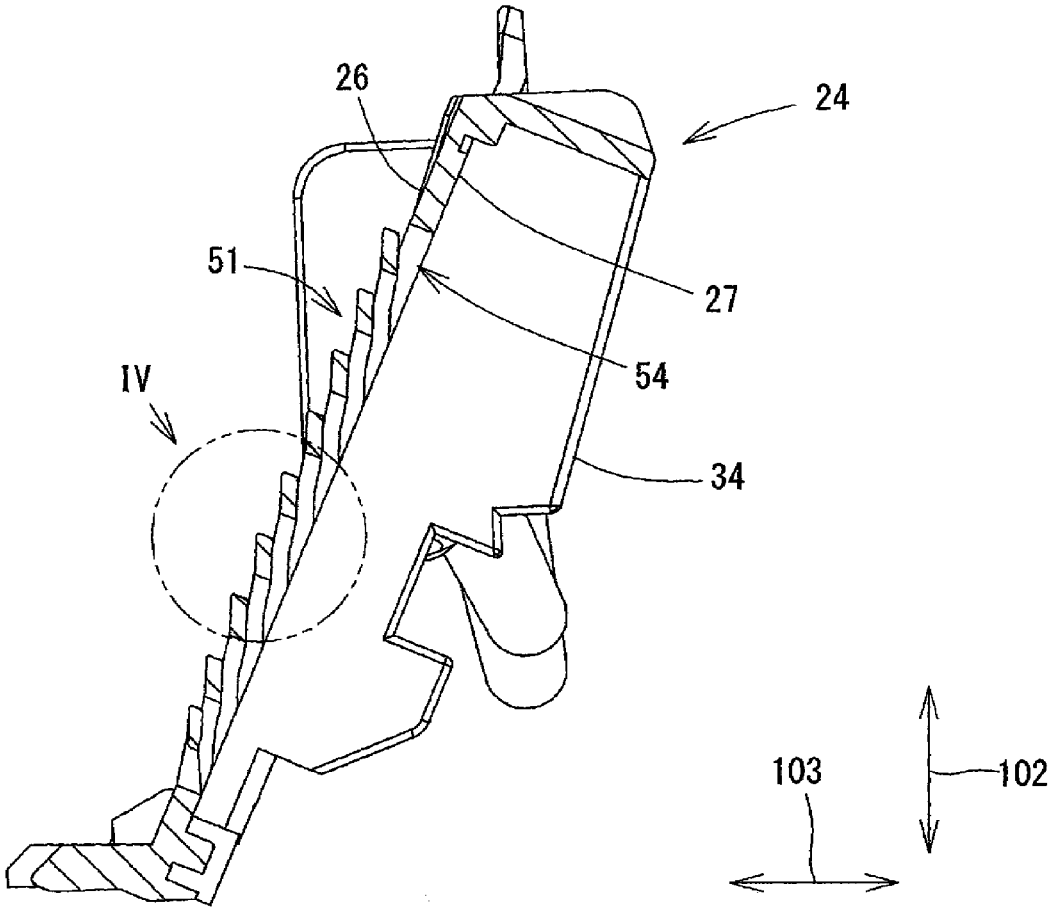
FIG. 3 is a cross-sectional view taken along line III-III in FIG. 2.

As shown in FIG. 3, there are provided ribs 34 extending in the height direction 102 on a back surface 27 of the inclined member 24 that is opposite to the inclined surface 26. The direction of extension of the ribs 34 is along the inclined surface 26 and also along the sheet feed direction 104. While only one rib 34 is shown in FIG. 3, the ribs 34 are provided on the back surface 27 at locations respectively corresponding to opposite sides of a row of separation protrusions 51 (which will be described in detail) in the width direction 101. The ribs 34 are formed integrally with the inclined member 24.

Figure 4:
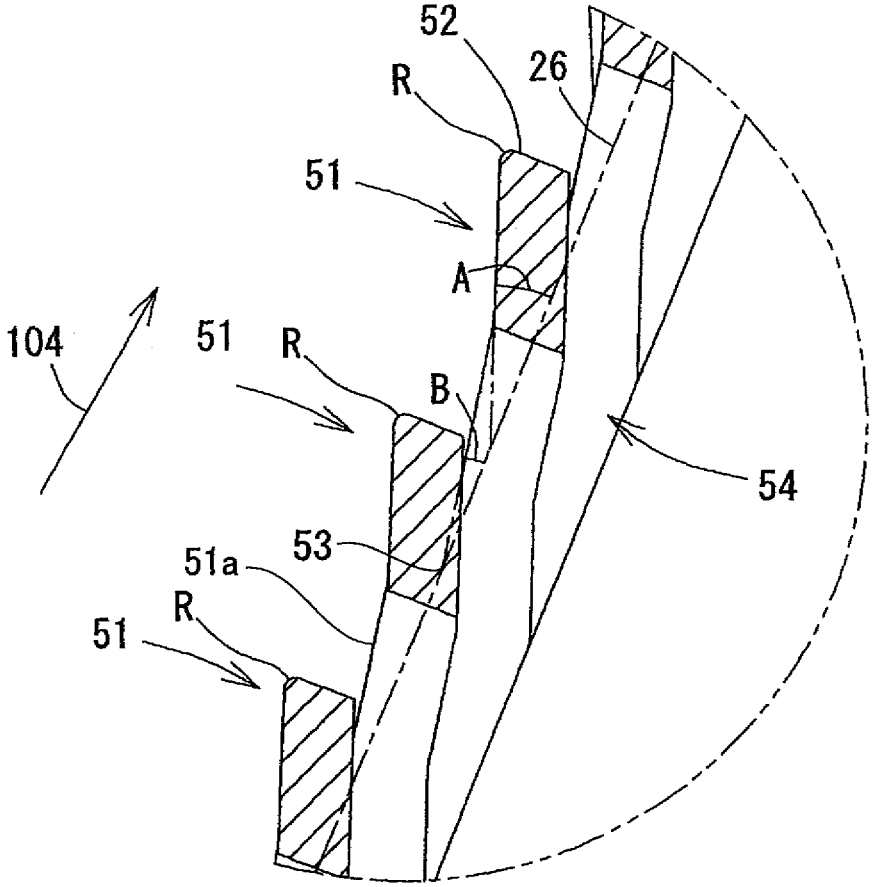
FIG. 4 is an enlarged cross-sectional view of a circled portion indicated by an arrow IV in FIG. 3.

As shown in FIG. 2, a plurality of separation protrusions 51 are provided on the inclined surface 26 of the inclined member 24. The separation protrusions 51 are formed integrally with the inclined member 24. Where the inclined member 24 is formed of a synthetic resin, for instance, the separation protrusions 51 are formed integrally with the inclined member 24 by molding. The separation protrusions 51 are arranged in a row in the sheet feed direction 104 at a position of the inclined surface 26 which is middle in the width direction 101 and which is the same as the position of the sheet supply roller 30 in the width direction 101. Each separation protrusion 51 protrudes from the inclined surface 26 toward the recording sheets on the bottom plate 21 of the sheet cassette 20. As shown in FIGS. 3 and 4, each separation protrusion 51 protrudes toward the downstream side in the sheet feed direction 104 slantingly relative to the inclined surface 26, namely, a portion of each separation protrusion 51 near to its distal end 52 (hereinafter referred to as "distal-end-side portion" where appropriate) is located more downstream in the sheet feed direction 104 than a portion thereof near to its proximal end 53 (hereinafter referred to as "proximal-end-side portion" where appropriate). The surface of each separation protrusion 51 that faces the leading edges of the recording sheets in the sheet cassette 20 functions as a contact surface 51*a*. Each of the sheets supplied from the sheet cassette 20 comes into contact with one or more contact surfaces 51*a* of the separation protrusions 51.

Each separation protrusion 51 has two arms at the portion thereof near to the proximal end 53, and the two arms are integrally connected to each other at the portion thereof near to the distal end 52. The protrusion amount of each separation protrusion 51 in the sheet feed direction 104 is set such that the distal end 52 of one separation protrusion 51 is located more downstream in the sheet feed direction 104 than the proximal end 53 of another separation protrusion 61 that is located adjacent to and immediately downstream of that one separation protrusion 51 in the sheet feed direction 104. The distal end 52 of that one separation protrusion 51 extends at least to a position corresponding to a position that is middle between the distal end 52 and the proximal end 53 of another separation protrusion 51 located immediately downstream of that one separation protrusion 51 in the sheet feed direction 104. The distal-end-side portion of that one separation protrusion 51 is located between the two arms of another separation protrusion 51 located immediately downstream of that one separation protrusion 51. That is, each separation protrusion 51 is formed such that the one separation protrusion 51 partly overlaps another separation protrusion 51 located immediately downstream thereof in the sheet feed direction 104, as seen in a direction perpendicular to the inclined surface 26.

As shown in FIG. 2, each separation protrusion 51 has a tapered shape in which its width dimension as measured in the width direction 101, i.e., a distance from one of the two arms to the other of the two arms, gradually decreases from the proximal end 53 toward the distal end 52. In other words, the separation protrusion 51 has a trapezoidal shape in which the width dimension at the distal end 52 is smaller than that at the proximal end 58, as seen in the direction perpendicular to the inclined surface 26.

As shown in FIG. 4, the corner portions at the distal end 52 of each separation protrusion 51 nearer to the recording sheets on the bottom plate 21 are rounded so as to have a curved surface. In other words, each separation protrusion 51 is formed such that the edge of the contact surface 51*a* at the distal end 52 is rounded. Further, the separation protrusion 51 is formed such that an angle "A" of a portion of the contact surface 51*a* near to the distal end 52 relative to the inclined surface 26 is made larger than an angle "B" of a portion of the contact surface 51*a* near to the proximal end 53 relative to the inclined surface 26, i.e., A>B. In other words, the separation protrusion 51 is bent so as to rise from the inclined surface 26, in the direction of protrusion of the separation protrusion 51 from the proximal end 58 toward the distal end 52.

As shown in FIG. 4, the inclined member 24 has through-holes 54 into each of which at least a part of a corresponding one of the separation protrusions 51 is pushed down, which part is near to the proximal end 53. In other words, the inclined member 24 has recessed portions in the form of the through-holes 54 into each of which at least a part of a corresponding one of the separation protrusions 51 is pushed clown beyond the inclined surface 26. Each through-hole 54 is a space that is contiguous to a apace between the two arms of the separation protrusion 51. The proximal-end-side portion of each separation protrusion 51 is accommodated into a corresponding one of the through-holes 54 when each separation protrusion 51 is elastically deformed so as to fall down toward the inclined surface 26. Each through-hole 54 is a recessed portion according to the invention. The recessed portion is not limited to a hole, such as the through-hole 54, formed through the thickness of the inclined member 24, but may be provided as a recess having a bottom into which the proximal-end-side portion of the each separation protrusion 51 can be accommodated. In the present embodiment, the recessed portions, i.e., the through-holes 54, are contiguous to each other. Accordingly, it may be considered that there is formed, in the inclined member 24, a single recessed portion into which elastically deformed separation protrusions 51 are partially accommodated.

[Separation of Recording Sheets]

The uppermost one of the sheets stacked on the bottom plate 21 of the sheet cassette 20 is fed in the sheet feed direction 104 by the rotation of the supply roller 30. On this occasion, the recording sheets under the uppermost sheet are sometimes fed in the sheet feed direction 104 together with the uppermost sheet, due to the friction, the static electricity, generated between the sheets, or the like. The leading edges of the thus fed recording sheets come into contact with one or more separation protrusions 51 when guided in the slantingly upward direction along the inclined surface 26.

If the recording sheets are hard to bend, the separation protrusion 51 with which the leading edges of the sheets come into contact is elastically deformed so as to lie down toward the inclined surface 26. Owing to the elastic deformation, the proximal-end-side portion of each separation protrusion 51 is pushed down into the through-hole 54. On the other hand, if the recording sheets are easy to bend, the separation protrusion 51 is hardly elastically deformed even if the leading edges of the recoding sheets come into contact therewith.

The recording sheets are further moved or fed in the sheet feed direction 104 such that the leading edges thereof slide on the contact surface 51*a* extending from the proximal end 53 to the distal end 52 of each of one or more separation protrusions 51. The angle of the distal-end-side portion of the contact surface 51*a* relative to the inclined surface 26 is made large so as to protrude toward the recording sheets much more than the proximal-end-side portion of the contact surface 51*a*. Accordingly, when the leading edges of the recording sheets are moved toward the distal-end-side portion, the distal-end-side portion exhibits a braking action to hinder the feeding of the recording sheets owing to its inclination, irrespective whether the separation protrusion 51 is elastically deformed or not. In an instance where the separation protrusion 51 is not elastically deformed, the proximal-end-side portion similarly exhibits the braking action. Accordingly, the braking action of each separation protrusion 51 works more largely on the recording sheets which are fed in the sheet feed direction 104 by a smaller force, namely, the recording sheets other than the uppermost sheet contacting the sheet supply roller 30 among the recording sheets to come into sliding contact with the separation protrusions 51. It is noted that the braking action described above is larger at the distal-end-side portion since the angle of the distal-end-side portion of the contact surface 51*a* relative to the inclined surface 26 is made larger than the angle of the proximal-end-side portion of the contact surface 51*a* relative to the inclined surface 26.

In an instance where the recording sheets other than the uppermost sheet cannot be completely stopped in spite of the above-described braking action of one separation protrusion 51 on which the sheets have slid, and pass over that one separation protrusion 51 after all, the recording sheets subsequently come into contact with next separation protrusion 51 that is disposed immediately downstream of that one separation protrusion 51 in the sheet feed direction 104. As described above, the separation protrusions 51 are provided on the inclined surface 26 such that any adjacent two separation protrusions 51 partly overlap each other. Accordingly, the distal end 52 of that one separation protrusion 51 extends to the position of the proximal end 53 of the next separation protrusion 51 located immediately downstream of that one separation protrusion 51, whereby the leading edges of the recording sheets come into contact with the next separation protrusion 51 without contacting the inclined surface 26 after having passed over that one separation protrusion 51. Thus, the above-described braking action is always exhibited, with respect to the recording sheets, between any adjacent two separation protrusions 51. Every time when the leading edges of the recording sheets pass over each separation protrusion 51, the recording sheets repeatedly undergo the braking action, whereby the leading edges of the recording sheets are separated.

When the recording sheet passes over one or more separation protrusions 51, the recording surface of the recording sheet slides on the distal end 52 of each of the one or more separation protrusions 51. Since the corner portions of the contact surface 51*a* at the distal end 52 are rounded, the recording surface is prevented from being damaged.

In the illustrated embodiment, the separation protrusions 51 are formed integrally with the inclined member 24 of the sheet cassette 20. Accordingly, the protrusion amount of the separation protrusions 51 can be controlled with high accuracy, thereby ensuring stabilized ability of preventing the multiple sheet feeding by the separation protrusions 51.

Each separation protrusion 51 is formed such that the distal end 52 of one separation protrusion 51 is located more downstream in the sheet feed direction 104 than the proximal end 53 of another separation protrusion 51 that is located adjacent to and immediately downstream of the one separation protrusion 51 in the sheet feed direction 104. According to the arrangement, the distance between any adjacent two separation protrusions 51 can be made small, thereby improving sheet separation ability of separating the recording sheets. As a result, the ability of preventing the multiple sheet feeding by the separation protrusions 51 can be enhanced.

In each separation protrusion 51, the angle "A" defined by the distal-end-side portion of the contact surface 51*a* and the inclined surface 26 is made larger than the angle "B" defined by the proximal-end-side portion of the contact surface 51*a* and the inclined surface 26. The braking action by which the leading edge of each sheet is stopped becomes large with an increase in the angle defined by the contact surface 51*a* and the inclined surface 26. Therefore, by increasing the angle at the distal-end-side portion with which the leading edge of each sheet frequently comes into contact, the sheet separation ability by each separation protrusion 51 can be enhanced. As a result, the ability of preventing the multiple sheet feeding by the separation protrusion 51 can be enhanced:

The inclined member 24 is formed with the through-holes 54 into each of which a part of a corresponding one of the separation protrusions 51 is pushed down, which part is near to the proximal end 53. In other words, the inclined member 24 has the recessed portions in the form of the through-holes 54 into each of which at least a part of a corresponding one of the separation protrusions 51 is pushed down beyond the inclined surface 26. The arrangement is effective for increasing the elastic deformation amount of each separation protrusion 51. Accordingly, each separation protrusion 51 is suitably elastically deformed when contacting the recording sheet that is hard to bend and exhibits suitable sheet separation ability, thereby preventing the feeding failure of the recording sheet that is hard to bend.

In each of the separation protrusions 51, the edge of the contact surface 51*a* at the distal end 52 is rounded, whereby the recording surface of the sheet that slides on the distal end 52 is prevented from being damaged.

The ribs 34 are provided on the back surface 27 of the inclined member 24, so that the portion of the inclined member 24 at which the separation protrusions 51 and the through-holes 54 are formed is reinforced by the ribs 34. Further, the ribs 34 are provided at the locations respectively corresponding to the opposite sides of the row of the separation protrusions 51 in the width direction 101. Accordingly, the surface accuracy of the portion of the inclined surface 26 at which the separation protrusions 51 are formed is ensured, and the leading edge of each sheet can contact one or more separation protrusions 51 with high accuracy.

2. First Modified Embodiment

Figure 5:
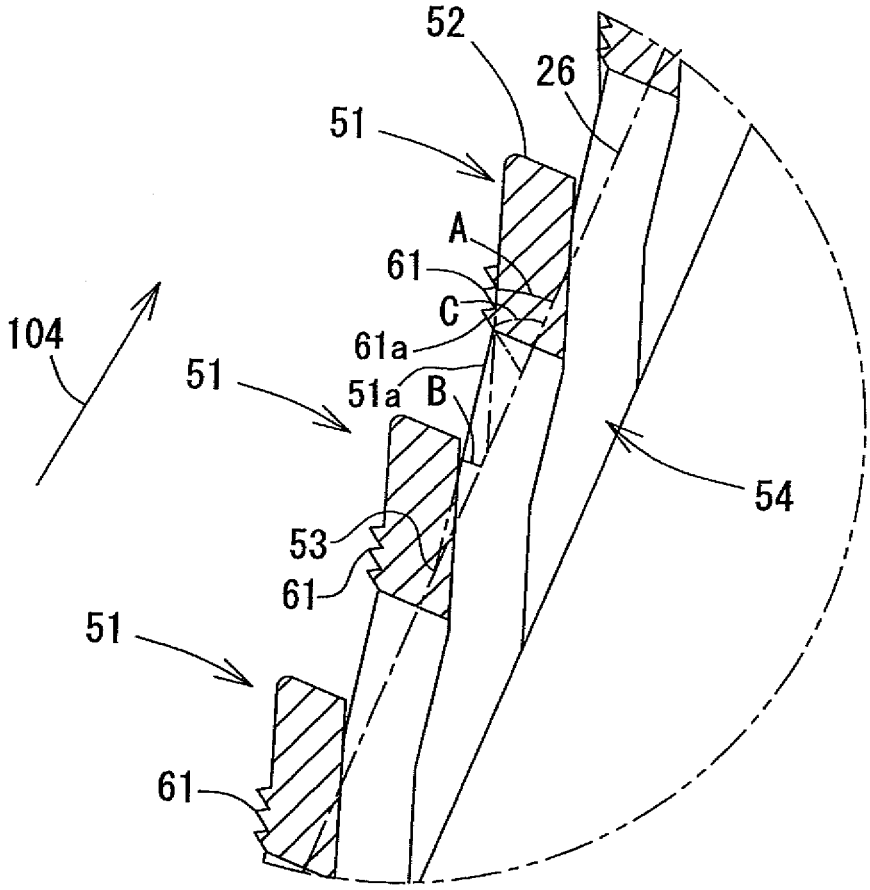
FIG. 5 is an enlarged cross-sectional view showing a first modified embodiment.

There will be next explained a first modified embodiment with reference to FIG. 5. This first modified embodiment is substantially identical in construction with the illustrated embodiment of FIGS. 1-4 except that each separation protrusion 51 has projections 61. Accordingly; the following explanation will be made focusing on only a detailed structure of the projections 61.

As shown in FIG. 5, on the contact surface 51*a* of each separation protrusion 51 that faces the recording sheets on the bottom plate 21 of the sheet cassette 20, three projections 61 are formed between the distal end 52 and the proximal end 53 and in the vicinity of an angle-changing point at which the angle defined by the contact surface 51*a* and the inclined surface 26 changes between "A" and "B". Each projection 61 projects toward the recording sheets on the bottom plate 21. While the three projections 61 are formed on each separation protrusion 51 in this first modified embodiment, the number of the projections 61 is arbitrary as long as not smaller than one.

Each projection 61 projects from the contact surface 51*a* as shown in FIG. 5, and its top end line extends over the entire width of the separation protrusion 51 as measured in the width direction 101. In each projection 61, an angle "C" of a surface 61*a* that faces the recording sheets on the bottom plate 21, relative to the inclined surface 26 of the inclined member 24 is made larger than the angles "A" and "B" of the contact surface 51*a* relative to the inclined surface 26, namely, C>A>B. The thus formed projections 61 are disposed on the contact surface 51*a* of each separation protrusion 51 so as to be arranged in a row along the sheet feed direction 104.

As in the illustrated embodiment of FIGS. 1-4, when each of the recording sheets placed on the sheet cassette 20 is supplied therefrom, the leading edge of the sheet slides on the proximal-end-side portion of the contact surface 51*a* of each of one or more separation protrusions 51 and subsequently comes into contact with each projection 61 of each of the one or more separation protrusions 51. Since the angle "C" of the surface 61*a* of the projection 61 relative to the inclined surface 26 is made larger than the above-indicated angles "A" and "B", the braking action works more strongly on each recording sheet, thereby ensuring the improved sheet separation ability in the event of the multiple sheet feeding. Further, the contact surface 51*a* of each separation protrusion 51 is roughened by the projections 61, so that the frictional resistance to be given to the leading edge of each sheet becomes large, resulting in improved sheet separation ability in the event of the multiple sheet feeding. In this respect, the contact surface 51*a* may be subjected to graining or embossing, in place of forming the projections 61, for larger frictional resistance.

3. Second Modified Embodiment

Figure 6:
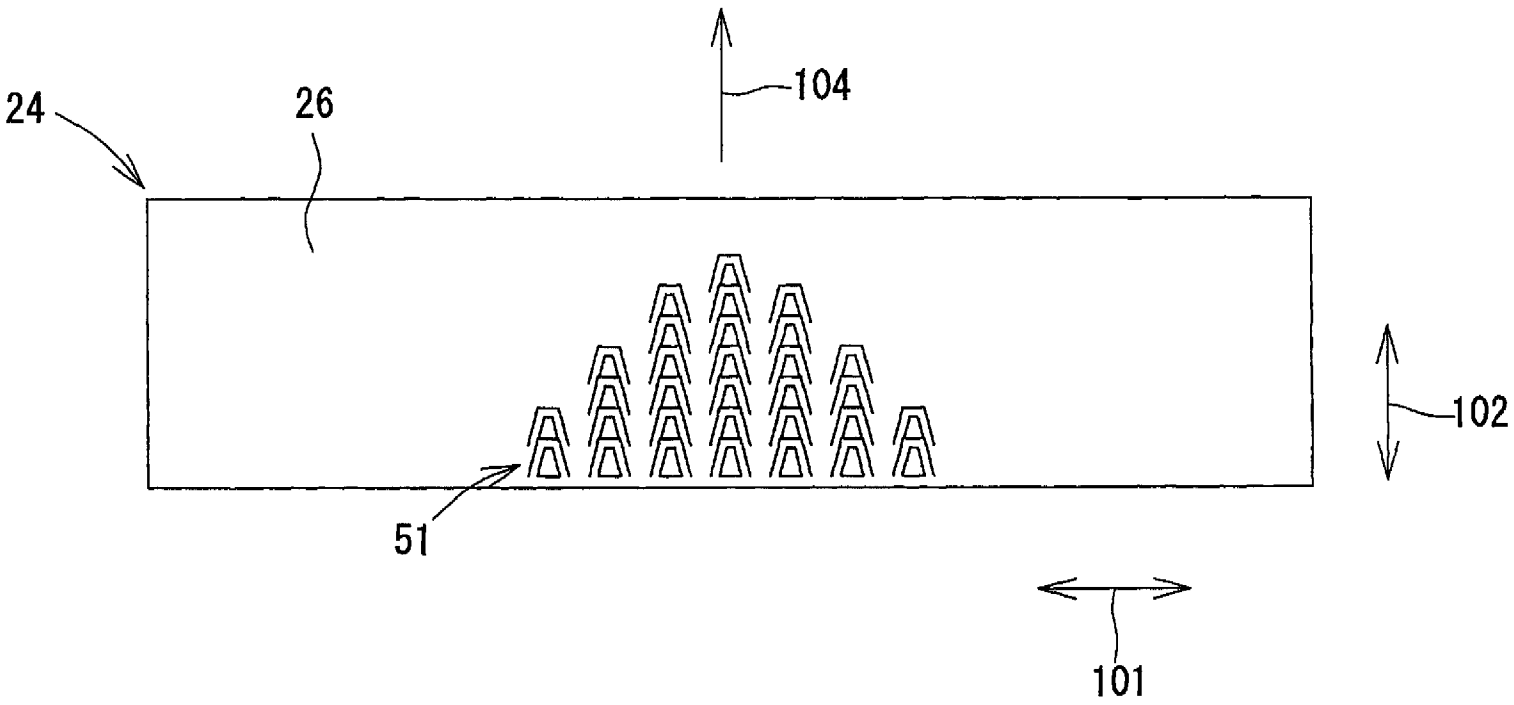
FIG. 6 is a schematic view showing an inclined member according to a second modified embodiment.

There will be next explained a second modified embodiment with reference to FIG. 6. This second modified embodiment is substantially identical in construction with the illustrated embodiment of FIGS. 1-4 except for the layout of the separation protrusions 51 on the inclined surface 26. Accordingly, the following explanation will be made focusing on only the layout of the separation protrusions 51.

As shown in FIG. 6, the separation protrusions 51 are disposed in plural numbers at the lower end portion of the inclined surface 26 along the width direction 101, and the number of the separation protrusions 51 along the width direction 101 decreases toward the upper end portion of the inclined surface 26, namely, toward the downstream side in the sheet feed direction 104. In other words, the separation protrusions 51 are disposed in a plurality of rows that are arranged in the width direction 101, and the number of the rows decreases toward the downstream side in the sheet feed direction 104. It is needed that the number of the separation protrusions 51 does not increase toward the upper end portion of the inclined surface 26. In this respect, the same number of the separation protrusions 51 disposed at the lower end portion of the inclined surface 26 may be disposed at the upper end portion of the same 26.

During feeding of the recording sheets from the sheet cassette 20 described above, the rotational force of the sheet supply roller 30 tends to easily transmit to the uppermost sheet as the arm 31 is pivoted more downward as a result of a decrease in the amount of the recording sheets placed on the bottom plate 21. Accordingly, the recording sheets located at the lower portion in the stack of the sheets on the bottom plate 21 are fed by a force larger than that by which the recording sheets located at the upper portion in the stack are fed. As described above, the number of the separation protrusions 51 decreases toward the upper end portion of the inclined surface 26. Therefore, the recording sheets that are located at the lower portion in the stack and that are fed by a larger force come into contact with a comparatively large number of the separation protrusions 51 while the recording sheets that are located at the upper portion in the stack and that are fed by a smaller force come into contact with a comparatively small number of the separation protrusions 51. Accordingly, the sheet separation ability can be appropriately maintained, thereby reducing occurrences of the multiple sheet feeding and the sheet misfeeding (the sheet feeding failure).

4. Third Modified Embodiment

Figure 7:
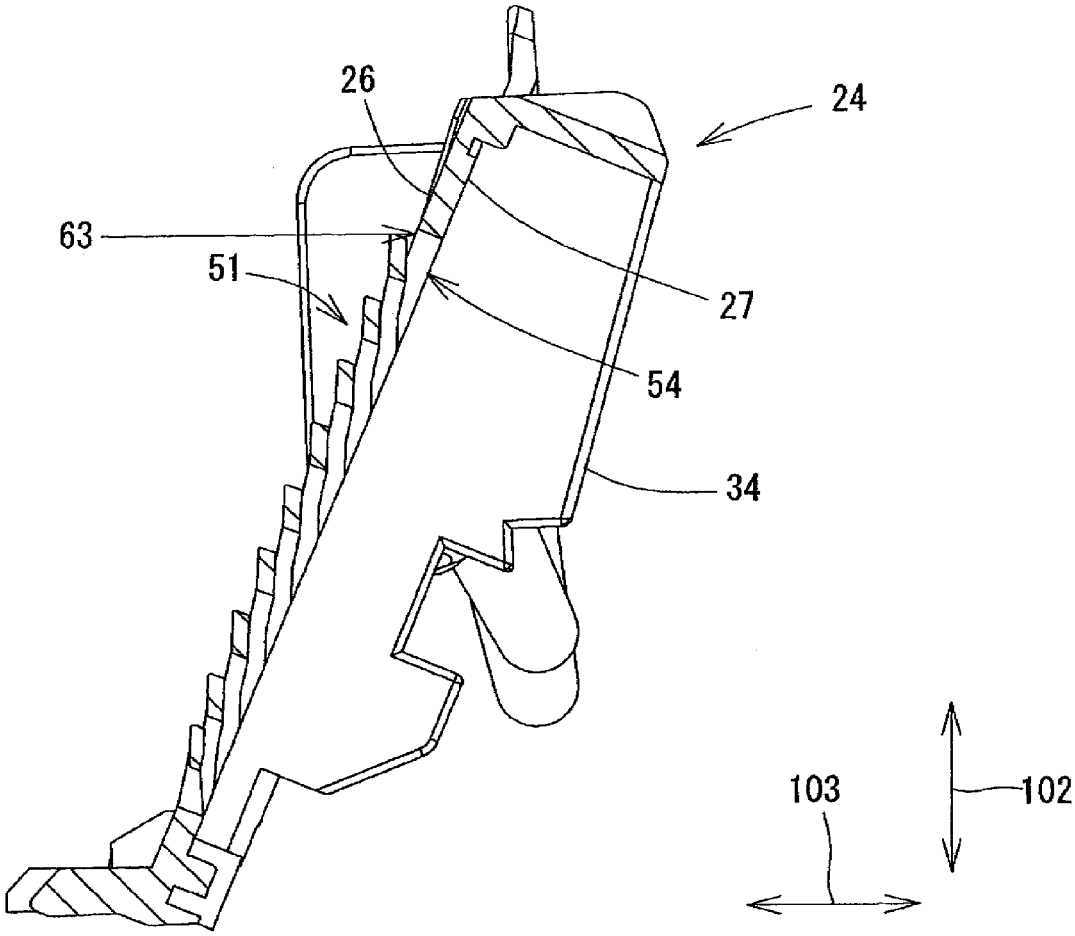
FIG. 7 is a cross-sectional view showing an inclined member according to a third modified embodiment.

There will be next explained a third modified embodiment with reference to FIG. 7. This third modified embodiment is substantially identical in construction with the illustrated embodiment of FIGS. 1-4 except for the layout of the separation protrusions 51 on the inclined surface 26. Accordingly, the following explanation will be made focusing on only the layout of the separation protrusions 51.

As shown in FIG. 7, all of the separation protrusions 51 are disposed only on the upstream side of a specific position 63 on the inclined surface 26 with which the leading edge of the uppermost recording sheet is in contact at a time when a maximum amount of the recording sheets are placed on the bottom plate 21 of the sheet cassette 20. In other words, all of the separation protrusions 51 are disposed at respective height positions each of which is lower than a height position of the uppermost one of the plurality of sheets at a time when a maximum amount of the sheets are placed on the bottom plate 21.

During feeding of the recording sheets from the sheet cassette 20 described above, the tam 31 is being pivoted upward when the amount of the recording sheets placed on the bottom plate 21 is large, and the rotational force of the sheet supply roller 30 is hard to transmit to the recording sheets. Accordingly, the recording sheets are fed by a smaller force. Therefore, the multiple sheet feeding is unlikely to occur whereas the sheet feeding failure tends to occur. When the amount of the recording sheets placed on the bottom plate 21 is large, the above-indicated braking action to work on the recording sheets is small where the number of the separation protrusions 51 over which the uppermost recording sheet passes or with which the uppermost sheet comes into contact is reduced or made equal to zero. Accordingly, the sheet feeding failure is unlikely to occur.

On the other hand, the rotational force of the sheet supply roller 30 tends to easily transmit to the uppermost sheet as the arm 31 is pivoted more downward as a result of a decrease in the amount of the recording sheets placed on the bottom plate 21. Accordingly, the recording sheets located at the lower portion in the stack of the sheets on the bottom plate 21 are fed by a force larger than a force by which the recording sheets located at the upper portion in the stack are fed. Therefore, the multiple sheet feeding tends to occur whereas the sheet feeding failure is unlikely to occur. Since the recording sheets located at the lower portion in the stack of the sheets on the bottom plate 21 need to come into contact with or pass over a comparatively large number of the separation protrusions 51, the above-indicated braking action to work on the recording sheets is large, so that the multiple sheet feeding is unlikely to occur.

5. Fourth Modified Embodiment

Figure 8:
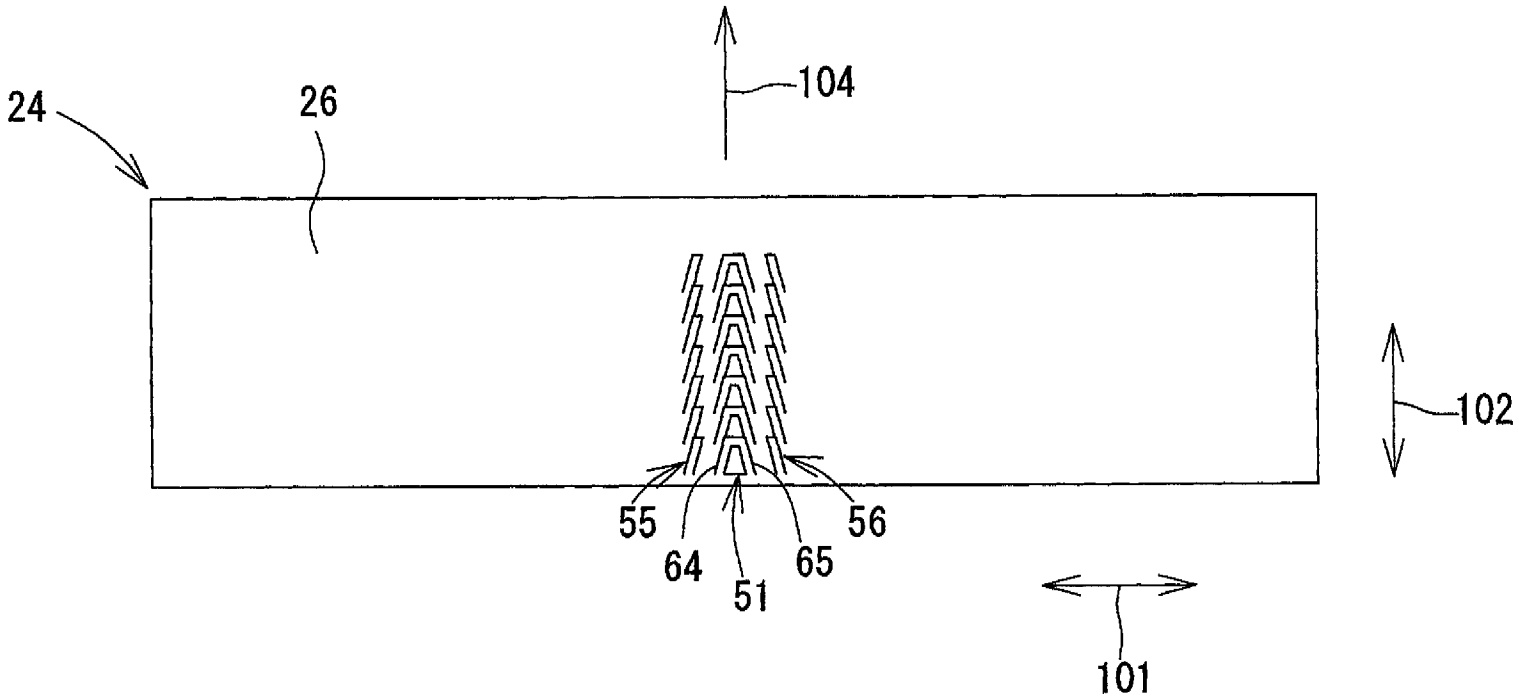
FIG. 8 is a schematic view showing an inclined member according to a fourth modified embodiment.

There will be next explained a fourth modified embodiment with reference to FIG. 8. This fourth modified embodiment is substantially identical in construction with the illustrated embodiment of FIGS. 1-4 except for the layout of the separation protrusions 51 on the inclined surface 26 and the configuration of some of the separation protrusions 51. Accordingly, the following explanation will be made focusing on only the layout and the configuration.

As shown in FIG. 8, the separation protrusions are disposed on the inclined surface 26 in a plurality of rows, three rows in this fourth modified embodiment, that are arranged in the width direction 101. Each of the separation protrusions 51 that belong to the middle row has two arms 64, 65 which extend from the proximal end 53 and which are integrally connected to each other at the distal end 52. On opposite sides of the middle row in the width direction 101, a row of separation protrusions 55 and a row of separation protrusions 56 are respectively provided. Each of the separation protrusions 55, 56 has one arm which extends from the proximal end. Each of the separation protrusions 55, 56 is inclined relative to the sheet feed direction 104 so as to be parallel to a corresponding one of the arms 64, 65 adjacent thereto.

During feeding of the recording sheets from the sheet cassette 20 described above, some of the separation protrusions 51, 65, 56 come into contact with the leading edge of each recording sheet at the position of the inclined surface 26 which is middle in the sheet width direction 101 and which is the same as the position of the sheet supply roller 30 in the sheet width direction 101. As explained above, each separation protrusion 51 has a symmetrical shape with respect to the center of the inclined surface 26 in the width direction 101. Further, the separation protrusions 55 and the separation protrusions 56 are formed and disposed symmetrically with respect to the center of the inclined surface 26 in the width direction 101. Accordingly, the separation protrusions 51, 55, 56 are disposed at a high density with good balance and come into uniform contact with the leading edge of the recording sheet, thereby preventing skewing of the recording sheet.

6. Fifth Modified Embodiment

Figure 9:
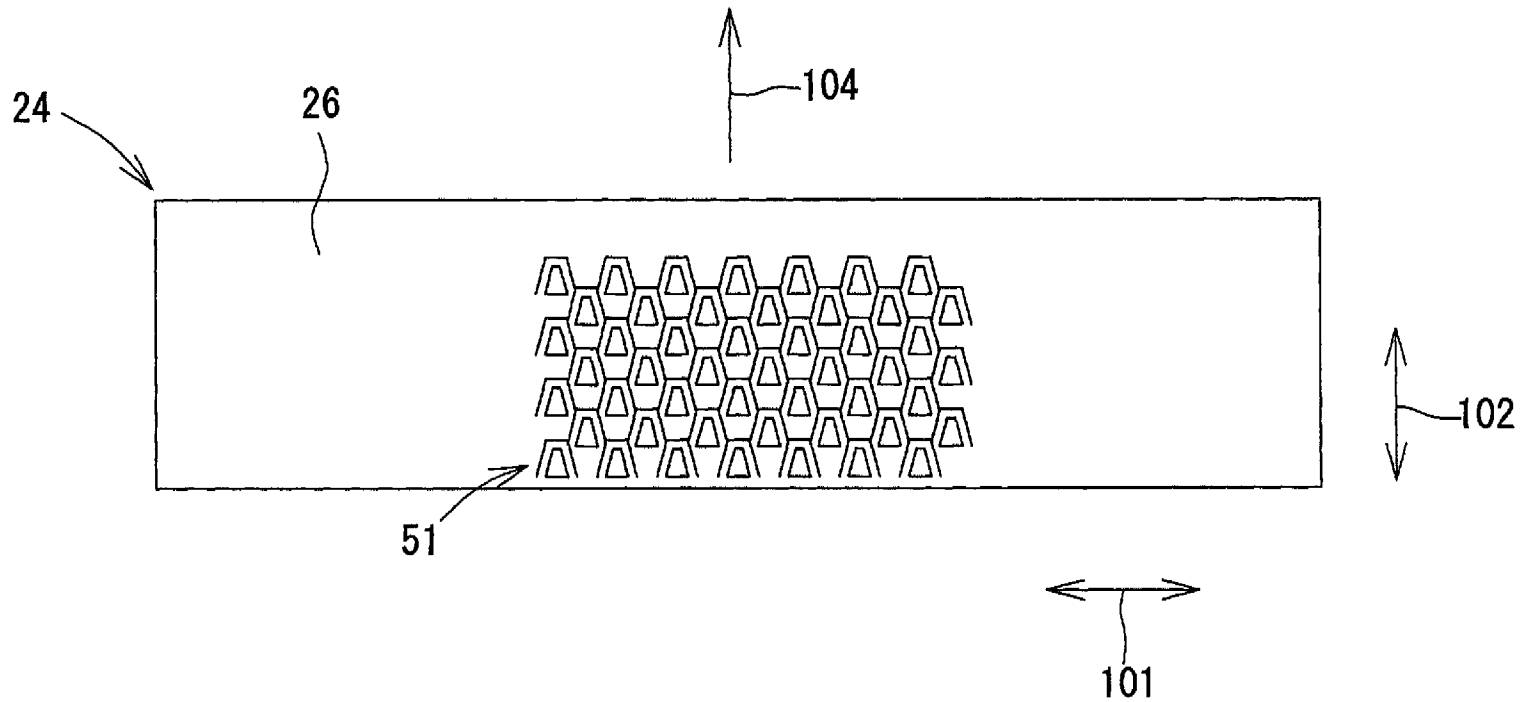
FIG. 9 is a schematic view showing an inclined, member according to a fifth modified embodiment.

There will be next explained a fifth modified embodiment with reference to FIG. 9. This fifth modified embodiment is substantially identical in construction with the illustrated embodiment of FIGS. 1-4 except for the layout of the separation protrusions 51 on the inclined surface 26. Accordingly, the following explanation will be made focusing on only the layout of the separation protrusions 51.

As shown in FIG. 9, the separation protrusions 51 are disposed such that one of the separation protrusions 51 is shifted by a suitable distance in the width direction 101 and is shifted by a suitable distance in the sheet feed direction 104, relative to any of the separation protrusions 51 disposed adjacent to that one of the separation protrusions 51. That is, the separation protrusions 51 are disposed in a zigzag fashion.

During feeding of the recording sheets from the sheet cassette 20 described above, the leading edge of each recording sheet and the plurality of separation protrusions 51 in the width direction 101 come into contact with each other, and the timing at which each separation protrusion 51 contacts the leading edge of the sheet differs at respective portions of the leading edge in the width direction 101. Accordingly, the sheet separation ability by the separation protrusions 51 is improved. The separation protrusions 51 shown in FIG. 9 may be considered as follows. Namely, seven separation protrusions 51 arranged in a zigzag fashion forms one row, and seven rows are arranged in the width direction 101.

7. Sixth Modified Embodiment

Figure 10:
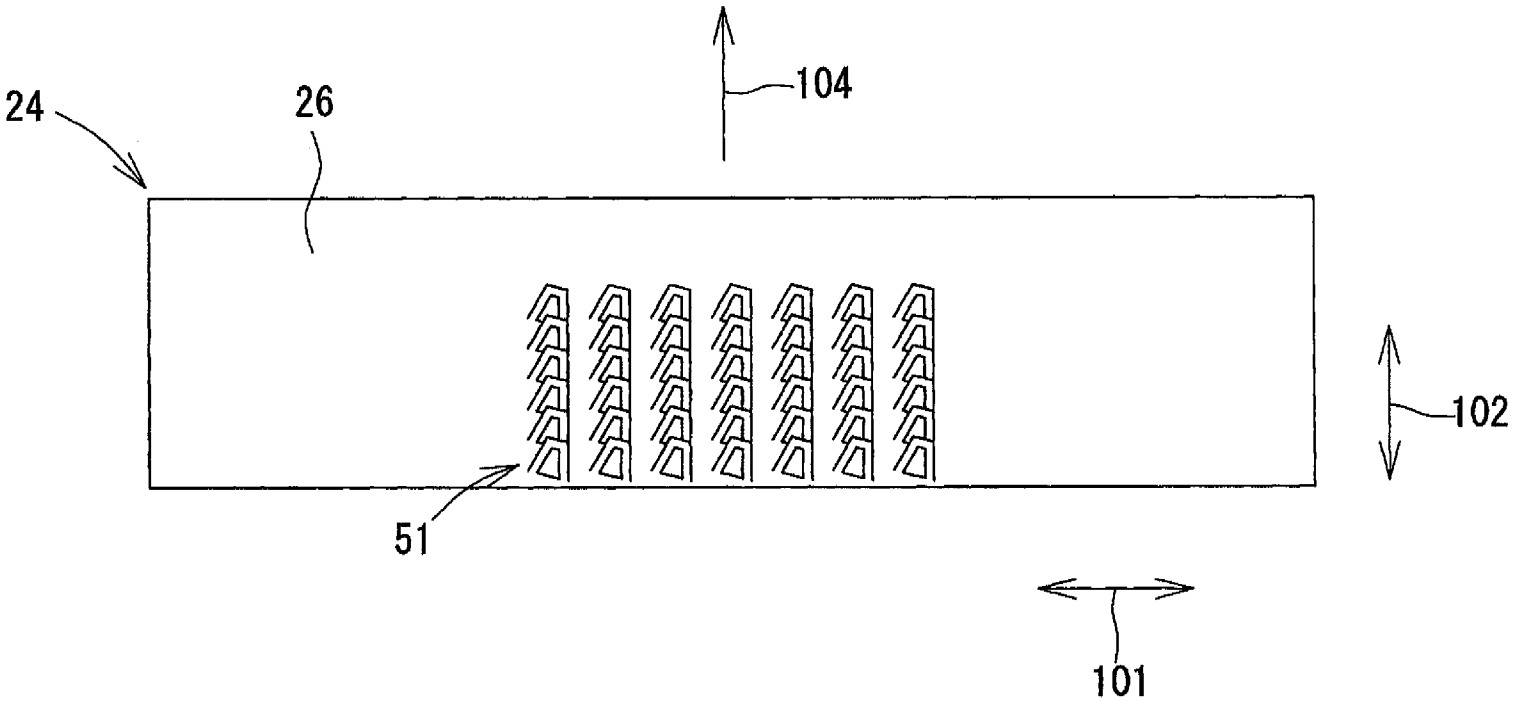
FIG. 10 is a schematic view showing an inclined member according to a sixth modified embodiment.

There will be next explained a sixth modified embodiment with reference to FIG. 10. This sixth modified embodiment is substantially identical in construction with the illustrated embodiment of FIGS. 1-4 except for the layout of the separation protrusions 51 on the inclined surface 26. Accordingly, the following explanation will be made focusing on only the layout of the separation protrusions 51.

As shown in FIG. 10, all of the separation protrusions 51 extend toward the downstream side in the sheet feed direction 104, more specifically, extend in the same direction that is inclined with respect to the sheet feed direction 104. While, in this sixth modified embodiment, the extension direction of the separation protrusions 51 intersects the sheet feed direction 104, all of the separation protrusion 61 may be disposed so as to extend in the same direction that is parallel to the sheet feed direction 104 as in the embodiments illustrated above.

During feeding of the recording sheets from the sheet cassette 20 described above, the separation protrusions 51 similarly contact the leading edge of the recording sheet, so that the skewing of the sheet is unlikely to occur.

8. Seventh Modified Embodiment

Figure 11:
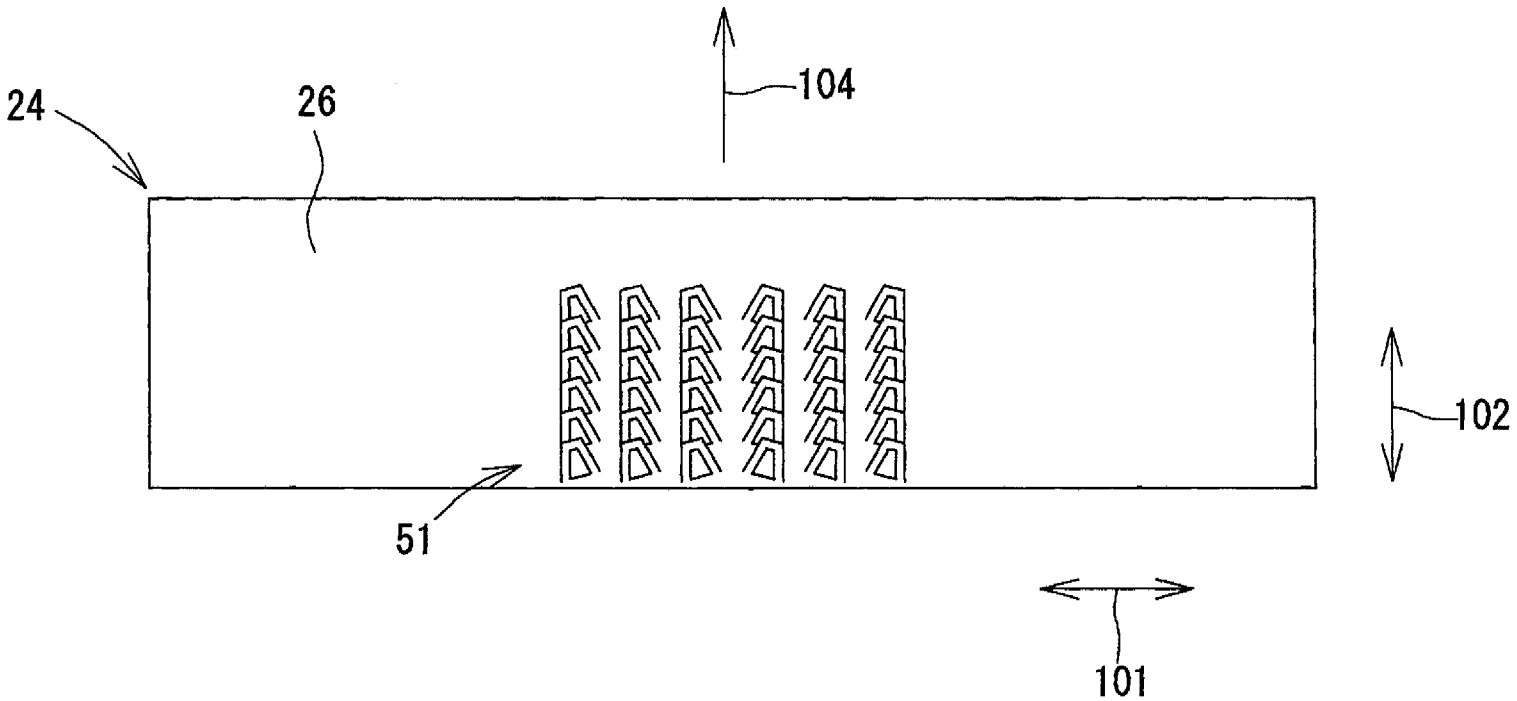
FIG. 11 is a schematic view showing an inclined member according to a seventh modified embodiment.

There will be next explained a seventh modified embodiment with reference to FIG. 11. This seventh modified embodiment is substantially identical in construction with the illustrated embodiment of FIGS. 1-4 except for the layout of the separation protrusions 51 on the inclined surface 26. Accordingly, the following explanation will be made focusing on only the layout of the separation protrusions 51.

As shown in FIG. 11, the separation protrusions 51 are disposed in a plurality of rows, and respective directions of extension of the separation protrusions 51 from the inclined surface 26 are symmetrical with respect to the middle position of the plurality of rows in the width direction 101 which is the same as the position of the sheet supply roller 30 in the width direction 101. Each separation protrusion 51 extends toward the downstream side in the sheet feed direction 104. While, in this seventh modified embodiment, the separation protrusions 51 extend outward in the width direction 101, namely, extend in directions away from the middle position of the plurality of rows, the separation protrusions 51 may extend toward the middle of the plurality of rows.

During feeding of the recording sheets from the sheet cassette 20 described above, the separation protrusions 51 contact the recording sheet with good balance in the width direction 101, so that the skewing of the sheet is unlikely to occur.

9. Eighth Modified Embodiment

Figure 12:
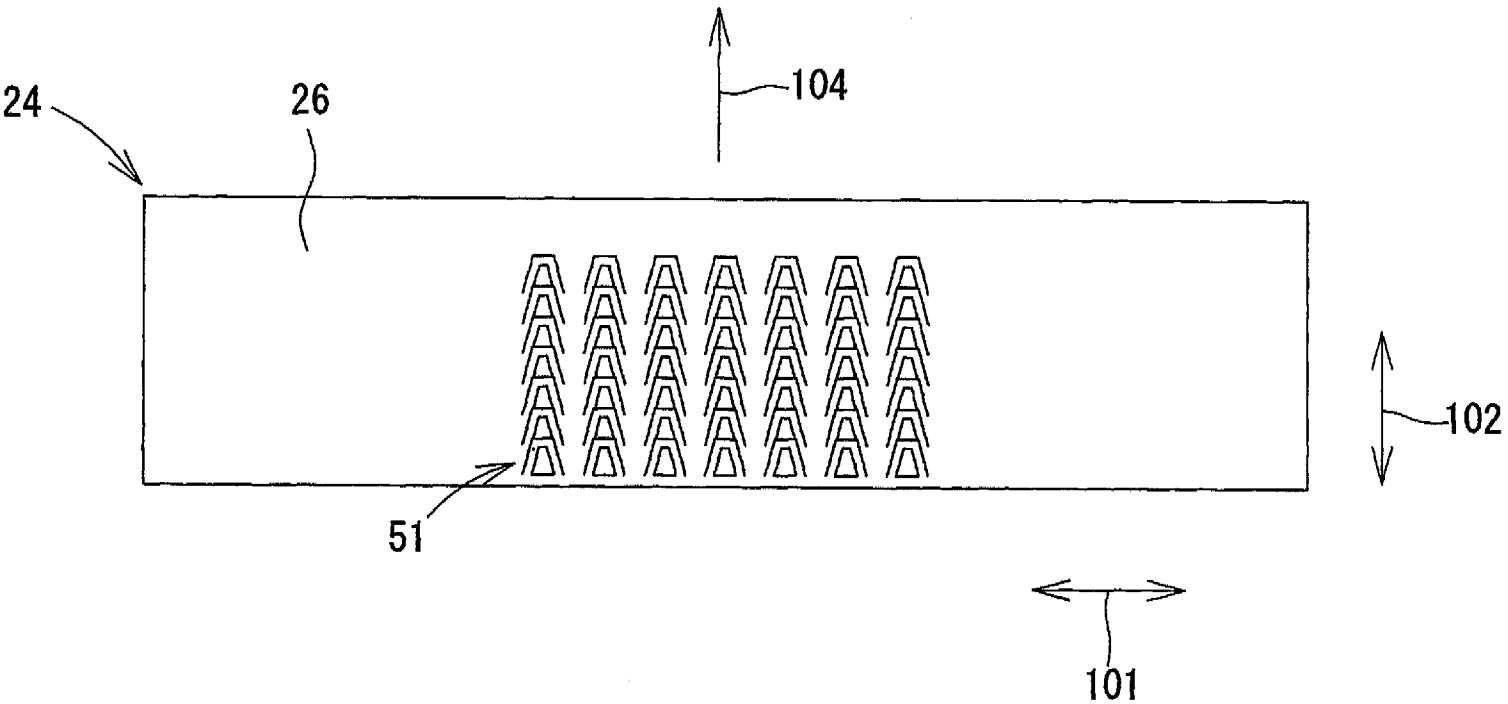
FIG. 12 is a schematic view showing an inclined member according to an eighth modified embodiment.
Figure 13:
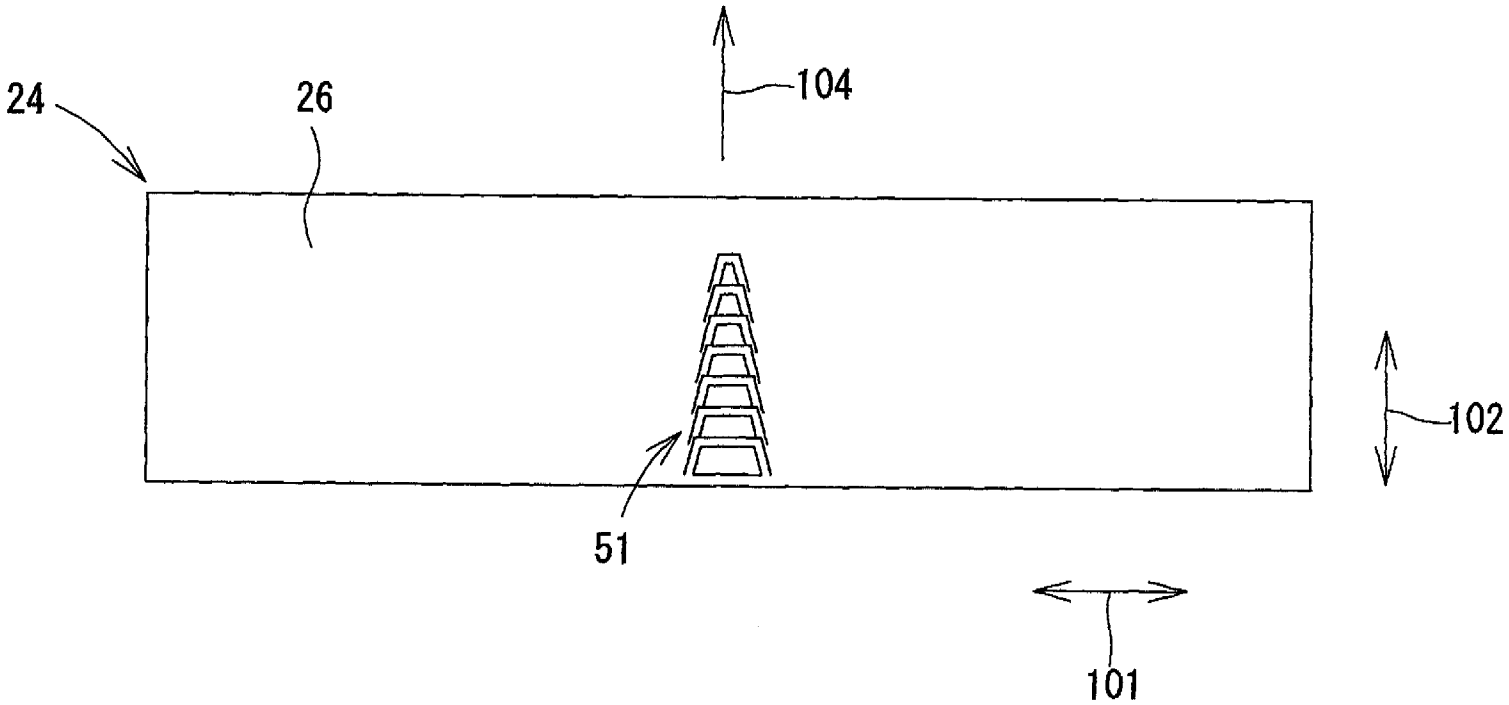
FIG. 13 is a schematic view showing an inclined member according to a ninth modified embodiment.

There will be next explained an eighth modified embodiment with reference to FIG. 12. This eighth modified embodiment is substantially identical in construction with the illustrated embodiment of FIGS. 1-4 except for the layout of the separation protrusions 51 on the inclined surface 26. Accordingly, the following explanation will be made focusing on only the layout of the separation protrusions 51.

As shown in FIG. 12, the separation protrusions 51 are disposed in a plurality of rows which are arranged in the width direction 101 and each of which extends in the sheet feed direction 104. The number of the separation protrusions 51 in each row is the same, and the separation protrusions 51 in each row are arranged at an equal pitch in the sheet feed direction 104.

During feeding of the recording sheets from the sheet cassette 20 described above, the separation protrusions 51 contact the recording sheet with goad balance in the width direction 101, so that the skewing of the sheet is unlikely to occur.

10. Ninth Modified Embodiment

There will be next explained a ninth modified embodiment with reference to FIG. 18. This ninth modified embodiment is substantially identical in construction with the illustrated embodiment of FIGS. 1-4 except for the width dimension of the separation protrusions 51 on the inclined surface 26. Accordingly, the following explanation will be made focusing on only the width dimension of the separation protrusions 51.

As shown in FIG. 18, each separation protrusion 51 has two arms which extends from the proximal end 58 and which are integrally connected to each other at the distal end 52. The respective width dimensions of the separation protrusions 51 as measured in the width direction 101 decrease toward the downstream Bide in the sheet feed direction 104. That is, each of the separation protrusions 51 is formed such that one of the separation protrusions 51 has the width dimension that is larger than the width dimension of another of the separation protrusions 51 that is located immediately downstream of that one of the separation protrusions 61 in the sheet feed direction 104.

During feeding of the recording sheets from the sheet cassette 20 described above, the arm 31 is being pivoted upward when the amount of the recording sheets placed on the bottom plate 21 is large. As a result, the rotational force of the sheet supply roller 30 is hard to transmit to the recording sheets. Accordingly, the recording sheets are fed by a smaller force. Therefore, the multiple sheet feeding is unlikely to occur whereas the sheet feeding failure tends to occur. When the amount of the recording sheets placed on the bottom plate 21 is large, the force that each separation protrusion 51 receives upon contacting the leading edge of the sheet is comparatively small. In view of this, each of the separation protrusions 51 disposed more downstream in the sheet feed direction 104 is constructed to have a smaller width dimension so as to be elastically deformed with ease.

On the other hand, the rotational force of the sheet supply roller 30 tends to easily transmit to the uppermost sheet as the arm 31 is pivoted more downward as a result of a decrease in the amount of the recording sheets placed on the bottom plate 21. Accordingly, the recording sheets located at the lower portion in the stack of the sheets on the bottom plate 21 are fed by a force larger than a force by which the recording sheets located at the upper portion in the stack are fed. Therefore, the multiple sheet feeding tends to occur whereas the sheet feeding failure is unlikely to occur. When the amount of the recording sheets placed on the bottom plate 21 is small, the force that each separation protrusion 51 receives upon contacting the leading edge of the sheet is comparatively large. In view of this, each of the separation protrusions 51 disposed more upstream in the sheet feed direction 104 is constructed to have a larger width dimension so as to be hard to be elastically deformed.

In this ninth modified embodiment, therefore, the respective width dimensions of the separation protrusions 51 as measured in the width direction 101 decrease toward the downstream side in the sheet feed direction 104 as described above. Accordingly, there is generated a comparatively large elastic resistance by the separation protrusions 51 having larger width dimensions, with respect to the recording sheets which are located at the lower portion in the stack on the bottom plate 21 and which are fed by a larger force. On the other hand, there is generated a comparatively small elastic resistance by the separation protrusions 51 having smaller width dimensions, with respect to the recording sheets which are located at the upper portion in the stack on the bottom plate 21 and which are fed by a smaller force. Therefore, the sheet separation ability is appropriately maintained, thereby reducing occurrences of the multiple sheet feeding and the sheet feeding failure.

11. Tenth Modified Embodiment

There will be next explained a tenth modified embodiment. This tenth modified embodiment is substantially identical in construction with the illustrated embodiment of FIGS. 1-4 except that the separation protrusions 51 are configured to receive mutually different loads when the separation protrusions 51 are elastically deformed by a certain amount. Accordingly, the following explanation will be made focusing on only the loads that the separation protrusions 51 receive when elastically deformed.

In this tenth modified embodiment, while not shown, each of the separation protrusions 51 disposed along the sheet feed direction 104 is formed such that one of the separation protrusions 51 elastically deforms more easily than another of the separation protrusions 51 that is located immediately upstream of that one of the separation protrusions 51. In other words, the respective degrees of ease of elastic deformation of the separation protrusions 51 increase toward the downstream side in the sheet feed direction 104. The degrees of ease of elastic deformation may be adjusted by changing the thickness values of the arms of the respective separation protrusions 51, for instance.

During feeding of the recording sheets from the sheet cassette 20 described above, the arm 31 is being pivoted upward when the amount of the recording sheets placed on the bottom plate 21 is large. As a result, the rotational force of the sheet supply roller 30 is hard to transmit to the recording sheets. Accordingly, the recording sheets are fed by a smaller force. Therefore, the multiple sheet feeding is unlikely to occur whereas the sheet feeding failure tends to occur. When the amount of the recording sheets placed on the bottom plate 21 is large, the force that each separation protrusion 51 receives upon contacting the leading edge of the sheet is comparatively small. In view of this, each of the separation protrusions 51 disposed more downstream in the sheet feed direction 104 is constructed to have a higher degree of ease of elastic deformation, namely, to have lower rigidity.

On the other hand, the rotational force of the sheet supply roller 30 tends to easily transmit to the uppermost sheet as the arm 31 is pivoted more downward as a result of a decrease in the amount of the recording sheets placed on the bottom plate 21. Accordingly, the recording sheets located at the lower portion in the stack of the sheets on the bottom plate 21 are fed by a force larger than a force by which the recording sheets located at the upper portion in the stack are fed. Therefore, the multiple sheet feeding tends to occur whereas the sheet feeding failure is unlikely to occur. When the amount of the recording sheets placed on the bottom plate 21 is small, the force that each separation protrusion 51 receives upon contacting the leading edge of the sheet is comparatively large. In view of this, each of the separation protrusions 51 disposed more upstream in the sheet feed direction 104 is constructed to have a lower degree of ease of elastic deformation, namely, to have higher rigidity.

In this tenth modified embodiment, therefore, the respective degrees of ease of elastic deformation of the separation protrusions 51 increase toward the downstream side in the sheet feed direction 104 as described above. Accordingly, there is generated a comparatively large elastic resistance by the separation protrusions 51 having lower degrees of ease of elastic deformation, with respect to the recording sheets which are located at the lower portion in the stack on the bottom plate 21 and which are fed by a larger force. On the other hand, there is generated a comparatively small elastic resistance by the separation protrusions 51 having higher degrees of ease of elastic deformation, with respect to the recording sheets which are located at the upper portion in the stack on the bottom plate 21 and which are fed by a smaller force. Therefore, the sheet separation ability is appropriately maintained, thereby reducing occurrences of the multiple sheet feeding and the sheet feeding failure.

12. Other Modifications

Each of the separation protrusions 51 in the illustrated embodiments of FIGS. 1-4 and the first through tenth modified embodiments may be configured such that the contact surface 51*a* has an angle relative to the inclined surface 26 of the inclined member 24 that is constant from the proximal end 53 to the distal end 52, as long as the angle is sufficient for separating the leading edges of the recording sheets.

The inclined member 24 need not be formed integrally with the sheet cassette 20, provided that the inclined member 24 is disposed to face the leading edges of the recording sheets. Accordingly, the inclined member 24 may be provided on the printer 11 so as to be independently of the sheet cassette 20.

The thickness of the arm of the separation protrusion 51, 55, 56 may be made larger at the portion near to the proximal end 58 than at the portion near to the distal end 52. The thus constructed separation protrusion is hard to be elastically deformed at the portion near to the proximal end 53 while easy to be elastically deformed at the portion near to the distal end 52. According to the arrangement, the separation protrusion has a higher resistance against the recording sheet at the proximal end 53 upon contacting the leading edge of the recording sheet, resulting in improved sheet separation ability.

The shape of the separation protrusion 51, 55, 56 may be suitably changed. For instance, the separation protrusion may have only one arm or a plurality of arms, extending from the proximal end 53. The width dimension of each separation protrusion 51 as measured in the width direction 101 may be made constant from the proximal end 53 to the distal end 52.

It is to be understood that the present invention may be otherwise embodied with various changes and modifications, which may occur to those skilled in the art, without departing from the scope of the invention defined in the attached claims.

What is claimed is:

1. A sheet feeder comprising:

a holding portion having a holding surface on which a plurality of sheets are held in a stack;

a supply portion configured to supply the plurality of sheets sequentially from an uppermost one of the plurality of sheets held on the holding portion;

an inclined member disposed downstream of the holding portion in a direction in which the sheets are supplied by the supply portion and having an inclined surface that is inclined relative to the holding surface and faces a leading edge of each of the sheets held on the holding portion, the inclined member being configured to guide said each of the sheets supplied from the holding portion in a sheet feed direction in which said each of the sheets is fed along the inclined surface; and a plurality of separation protrusions which are provided on the inclined member and arranged in the sheet feed direction and each of which protrudes from the inclined surface such that a distal end thereof is located more downstream in the sheet feed direction than a proximal end thereof, wherein each of the separation protrusions has a contact surface and said each of the sheets supplied from the holding portion comes into contact with one or more contact surfaces of the separation protrusions, wherein each of the separation protrusions protrudes from the inclined surface such that the distal end of one of the separation protrusions is located more downstream in the sheet feed direction than the proximal end of another of the separation protrusions that is located immediately downstream of the one of the separation protrusions in the sheet feed direction, and wherein each of the separation protrusions has at least one projection each of which is provided between the proximal end and the distal end so as to project from the contact surface.

2. The sheet feeder according to claim 1, wherein the inclined member and each of the separation protrusions are formed of a synthetic resin.

3. The sheet feeder according to claim 1, wherein each of the separation protrusions is formed such that an angle of a portion of the contact surface near to the distal end relative to the inclined surface is larger than an angle of a portion of the contact surface near to the proximal end relative to the inclined surface.

4. The sheet feeder according to claim 1, wherein the inclined member has recessed portions into each of which at least a part of a corresponding one of the separation protrusions is pushed down beyond the inclined surface.

5. The sheet feeder according to claim 1, wherein each of the separation protrusions is formed such that an edge of the contact surface at the distal end is rounded.

6. The sheet feeder according to claim 1, wherein each of the at least one projection has a surface with which the sheets supplied from the holding portion come into contact, and wherein an angle of the surface of said each of the at least one projection relative to the inclined surface is made larger than an angle of a portion of the contact surface of said each of the separation protrusions near to the proximal end relative to the inclined surface.

7. The sheet feeder according to claim 1, wherein all of the separation protrusions extend from the inclined surface toward the same direction.

8. The sheet feeder according to claim 1, wherein the inclined member has a plate shape, and one of opposite surfaces of the inclined member functions as the inclined surface, and wherein the inclined member has a rib provided on the other of the opposite surfaces thereof so as to extend in the sheet feed direction.

9. The sheet feeder according to claim 1, wherein the supply portion includes: an arm provided so as to be pivotable in an upward and downward direction about a proximal end portion thereof; and a roller provided at a distal end portion of the arm and configured to be rotated while being in contact with the uppermost one of the plurality of sheets held on the holding portion.

10. An image recording apparatus, comprising:

the sheet feeder defined in claim 1; and a recording portion configured to record an image on said each of the sheets that is fed by the sheet feeder.

11. The sheet feeder according to claim 1, wherein the proximal end of each of the separation protrusions extends from the inclined surface of the inclined member.

12. The sheet feeder according to claim 1, wherein the contact surface of each of the separation protrusions is flat.

13. The sheet feeder according to claim 1, wherein each of the separation protrusions is formed integrally with the inclined member.

14. The sheet feeder according to claim 1, wherein each of the separation protrusions has a tapered shape in which a width dimension thereof, as measured in a sheet width direction of said each of the sheets that is fed, decreases in a direction from the proximal end toward the distal end.

15. The sheet feeder according to claim 1, wherein each of the separation protrusions has two arms which extend from the proximal end and which are integrally connected to each other at the distal end.

* * * * *